US008230934B2

(12) United States Patent
Darby et al.

(10) Patent No.: US 8,230,934 B2
(45) Date of Patent: Jul. 31, 2012

(54) APPARATUS AND METHOD FOR DIRECTIONALLY DISPOSING A FLEXIBLE MEMBER IN A PRESSURIZED CONDUIT

(75) Inventors: John Gregory Darby, Lafayette, LA (US); Harold L. Becker, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 269 days.

(21) Appl. No.: 12/572,543

(22) Filed: Oct. 2, 2009

(65) Prior Publication Data

US 2011/0079402 A1 Apr. 7, 2011

(51) Int. Cl.
*E21B 19/08* (2006.01)

(52) U.S. Cl. ..... 166/385; 166/77.1; 166/85.1; 166/379

(58) Field of Classification Search ..... 166/385, 166/378, 379, 380, 65.1, 77.1, 85.1
See application file for complete search history.

(56) References Cited

U.S. PATENT DOCUMENTS

| | | | | |
|---|---|---|---|---|
| 4,193,451 | A | 3/1980 | Dauphine | |
| 4,817,711 | A | 4/1989 | Jeambey | |
| 4,819,723 | A | 4/1989 | Whitfill et al. | |
| 4,848,480 | A * | 7/1989 | Titchener et al. | 166/385 |
| 4,862,060 | A | 8/1989 | Scott et al. | |
| 4,865,747 | A | 9/1989 | Larson et al. | |
| 4,884,634 | A | 12/1989 | Ellingsen | |
| 4,902,961 | A | 2/1990 | De et al. | |
| 4,904,942 | A | 2/1990 | Thompson | |
| 4,926,941 | A | 5/1990 | Glandt et al. | |
| 4,973,811 | A | 11/1990 | Bass | |
| 5,012,868 | A | 5/1991 | Bridges | |
| 5,014,010 | A | 5/1991 | Helms et al. | |

(Continued)

FOREIGN PATENT DOCUMENTS

WO WO 01/03473 A1 1/2001

OTHER PUBLICATIONS

Arthur Unknown; "HydroFLOW Theory of Operation"; website http://www.hydroflow.force9.co.uk/theory.htm, visited Sep. 5, 2007; 2 pages.

(Continued)

*Primary Examiner* — William P Neuder
*Assistant Examiner* — Richard Alker
(74) *Attorney, Agent, or Firm* — McGlinchey Stafford, PLLC; R. Andrew Patty, II

(57) ABSTRACT

An apparatus and method for directionally disposing an elongated flexible member in a pressurized conduit. The method includes inserting a bent end portion of an elongated hollow body through an opening in fluid communication with a well valve and defined by a pressurized conduit, the bent end portion being disposed in a pre-determined direction and location within the pressurized conduit; inserting a lead portion of an elongated flexible member into a fluid passageway defined by a primary valve, the fluid passageway of the primary valve being in sealed fluid relationship with the elongated hollow body which, in turn, is in sealed fluid relationship with the pressurized conduit, so that the lead portion of the elongated flexible member is inserted through the bend end portion and into the pressurized conduit by a pre-determined distance; and thereafter retaining in place the inserted elongated flexible member, whereby the elongated flexible member is directionally disposed in the pressurized conduit.

11 Claims, 5 Drawing Sheets

U.S. PATENT DOCUMENTS 5,046,559 A 9/1991 Glandt
5,049,823 A 9/1991 Castel et al.
5,055,180 A 10/1991 Klaila
5,065,819 A 11/1991 Kasevich
5,076,727 A 12/1991 Johnson et al.
5,082,054 A 1/1992 Kiamanesh
5,107,219 A 4/1992 Marrelli et al.
5,109,927 A 5/1992 Supernaw et al.
5,114,497 A 5/1992 Johnson et al.
5,236,039 A 8/1993 Edelstein et al.
5,282,508 A 2/1994 Ellingsen et al.
5,293,936 A 3/1994 Bridges
5,299,887 A 4/1994 Ensley
5,323,855 A 6/1994 Evans
5,351,521 A 10/1994 Cracknell
5,370,477 A 12/1994 Bunin et al.
5,449,889 A 9/1995 Samardzija
5,453,693 A 9/1995 Sinclair et al.
5,484,985 A 1/1996 Edelstein et al.
5,485,743 A 1/1996 Taherian et al.
5,507,927 A 4/1996 Emery
5,514,283 A 5/1996 Stefanini
5,531,270 A 7/1996 Fletcher et al.
5,574,815 A 11/1996 Kneeland
5,667,677 A 9/1997 Stefanini
5,723,844 A 3/1998 Dow et al.
5,763,794 A 6/1998 Marrelli
5,829,519 A 11/1998 Uthe
5,877,995 A 3/1999 Thompson et al.
5,969,209 A 10/1999 Katoot
6,012,520 A 1/2000 Yu et al.
6,186,239 B1 * 2/2001 Monjure et al. ..... 166/384
6,189,611 B1 2/2001 Kasevich
6,192,752 B1 2/2001 Blaine
6,250,386 B1 6/2001 Ellingsen
6,307,191 B1 10/2001 Waycuilis
6,350,973 B2 2/2002 Wroe et al.
6,412,555 B1 7/2002 Sten-Halvorsen et al.
6,427,774 B2 8/2002 Thomas et al.
6,499,536 B1 12/2002 Ellingsen
6,541,979 B2 4/2003 Omeragic
6,617,556 B1 9/2003 Wedel
6,629,562 B1 10/2003 Fidan
6,650,280 B2 11/2003 Arndt et al.
6,658,944 B2 12/2003 Melnikov et al.
6,667,620 B2 12/2003 Homan et al.
6,691,779 B1 2/2004 Sezginer et al.
6,707,307 B1 3/2004 McFarlane et al.
6,755,246 B2 6/2004 Chen et al.
6,766,141 B1 7/2004 Briles et al.
6,771,080 B2 8/2004 Conrads et al.
6,819,112 B2 11/2004 Gianzero et al.
6,877,556 B2 4/2005 Wittle et al.
7,009,393 B2 3/2006 Cohen Addad et al.
7,055,599 B2 6/2006 Kasevich
7,091,460 B2 8/2006 Kinzer
7,109,457 B2 9/2006 Kinzer
7,115,847 B2 10/2006 Kinzer
7,135,870 B2 11/2006 Mohajer et al.
7,193,420 B2 3/2007 Chen et al.
7,221,169 B2 5/2007 Jean et al.
7,274,996 B2 9/2007 Lapinski et al.
7,312,428 B2 12/2007 Kinzer
7,331,385 B2 2/2008 Symington et al.
7,350,568 B2 4/2008 Mandal et al.
7,360,596 B2 4/2008 Steinbrecher et al.
7,398,823 B2 7/2008 Montgomery et al.
7,407,589 B2 8/2008 Holland
7,441,597 B2 10/2008 Kasevich
7,445,041 B2 11/2008 O'Brien
7,461,693 B2 12/2008 Considine et al.
7,486,248 B2 2/2009 Halek et al.
2002/0010373 A1 1/2002 Komata et al.
2004/0154792 A1 8/2004 Bofto
2005/0024284 A1 2/2005 Halek et al.
2006/0180304 A1 8/2006 Kasevich
2006/0254766 A1 11/2006 Richard et al.
2007/0108202 A1 5/2007 Kinzer
2007/0131591 A1 6/2007 Pringle
2007/0215613 A1 9/2007 Kinzer
2007/0289736 A1 12/2007 Kearl et al.
2008/0073079 A1 3/2008 Tranquilla et al.
2008/0087099 A1 4/2008 Allenberg et al.
2008/0156483 A1 7/2008 Zhuravlev et al.
2008/0230232 A1 * 9/2008 Farrara ..... 166/379
2008/0314730 A1 12/2008 Pringle

OTHER PUBLICATIONS

Bennion, D.B., et al., "Low Permeability Gas Reservoirs: Problems, Opportunities and Solutions for Drilling, Completion, Stimulation and Production", Society of Petroleum Engineers, Inc., SPE Gas Technology Symposium, 1996, p. 117-131.

Bennion, D. Brant, "An Overview of Formation Damage Mechanisms Causing a Reduction in the Productivity and Injectivity of Oil and Gas Producing Formations", Journal of Canadian Petroleum Technology, Nov. 2002, vol. 41, No. 11, p. 10-15.

"ClearWELL™ Technology Keeps Scale and Parrafin in Their Place-in Solution", article from W Magazine, a publication of Weatherford International, Ltd., Feb. 2007, vol. 9, No. 1, p. 22 (3 pages).

"Cracking an Oil Supply", The Engineer, Feb. 26, 2007; webiste http://www.theengineer.co.uk/news/cracking-an-oil-supply/298409.article (2 pages).

Crawford, Peter M., et al., "New approaches overcome past technical issues", Oil and Gas Journal, Jan. 26, 2009, p. 44-49.

Denney, Dennis, "Technology Applications", Journal of Petroleum Technology, Apr. 2007, vol. 59, No. 4 (4 pages).

Jamaluddin, A.K.M., et al., "Application of Heat Treatment to Enhance Permeability in Tight Gas Reservoirs", Journal of Canadian Petroleum Technology, Nov. 2000, vol. 39, No. 11, p. 19-24.

Literature Pamphlet by National Energy Technology Laboratory, "A Literature Review on Cold Cracking of Petroleum Crude Oil", Energy Policy Act of 2005 Section 1406, Jul. 2006, 30 pages.

Moore, Samuel K, "You Tell Us: Electron Beams Zap Oil to Pump More Petrol", IEEE Spectrum Online, Jan. 2007 (2 pages).

* cited by examiner

APPARATUS AND METHOD FOR DIRECTIONALLY DISPOSING A FLEXIBLE MEMBER IN A PRESSURIZED CONDUIT

TECHNICAL FIELD

This invention relates to an apparatus and method for directionally disposing an elongated flexible member within a pressurized conduit.

THE INVENTION

In the petroleum industry, it is well known that high molecular weight paraffin can precipitate from bulk crude oil in a hydrocarbon well leading to a restriction in the production piping and potential plugging of the flow path, including reservoir flow paths. Conventional treatments for such paraffin deposits typically require the use of various mechanical techniques, such as heat application or physical removal, or chemical techniques, such as chemical application or solvent removal. Mineral scales such as calcium carbonate or barium sulfate can precipitate from produced water and create blockages in flow paths, both in the formation and in production tubes, such as well tubing and flow lines. Conventional treatment against the deposition of mineral scale may include mechanical techniques, such as drilling and scraping, or chemical techniques, such as chemical scale inhibitors or dissolvers.

In addition to the aforementioned conventional treatments for the precipitation of mineral scales and paraffin, it has been found that radio and microwave frequencies wave forms may also be used to treat produced oilfield brines and hydrocarbons to reduce or eliminate paraffin and mineral scale blockage. In order to treat the intended production with the radio waves and/or microwaves, an antenna, e.g., flexible, coated wire, may be deployed into a pre-determined location in the pressurized well. Various types of antennas may be used depending on the practitioner and his/her needs, including, but not limited to, monopole, dipole or array antennas.

In pressurized hydrocarbon wells, it is known in the petroleum industry to use flexible wire/tubing to operate down hole tools and equipment with success. For example, slickline, a small diameter flexible wire, is used to safely deploy tools and equipment down pressurized wells to remove high molecular weight paraffin and mineral scales as well as to deploy tools for well control and maintenance. Another flexible wire, commonly know in the art as electric line, is used to deploy electrical cable into a well safely and under pressure for the purpose of operating electronic tools for well maintenance, measurement, and monitoring.

Although slickline and electric line are general examples of flexible wire deployed into wells under pressure, these flexible wires are typically used in relatively large diameter pipe (2⅜" to 2⅞" well tubing) and may enter the treatment area at 180 degrees, i.e., through an opening substantially coaxial with a longitudinal axis of the wellhead. Because the flexible wire enters from such a location, additional production components, such as rod strings for operating down-hole pumps, installed in the well may impede the entrance of such flexible wire into the well bore and typically need to be removed prior to introducing slickline or electric line or performing other invasive well maintenance operations, such as the introduction of one or more antennas into a well to treat the production fluid. It would be advantageous to be able to insert a flexible elongated member, such as an antenna, into a well including production components, e.g., tubing hanger, rod strings, etc., without the need for removal of such production components, thereby reducing costs, manpower, and time spent on the treatment of the well.

Additionally, in treating a well using one or more antennas transmitting radio and/or microwaves, it would be advantageous to dispose the antenna in a pre-determined location, such as the annular space between the casing and production tubing, commonly known in the art as the annulus. However, a flexible wire, including certain types of antennas, may present challenges during insertion into the well due to the inherent nonrigid structure of such wires when contacting various production components. In such situations, the flexible wire tends to accumulate proximate to the production component(s) obstructing the insertion path of the flexible wire.

Further, an antenna disposed within the pressurized well may be a flexible, conductive wire including a metal sheath. In order to eliminate the possibility of the wire and/or metal sheath from contacting the casing or production tubing and shorting, a coating is applied to the flexible wire. One such known nonlimiting example is a coaxial cable. Fluid and pressure may accumulate between the coating and the wire in the pressurized well. Thus, potential for leaking of the pressure and fluid exists in the portion of the antenna located outside of the wellhead. It would be advantageous to insert an antenna including a coating into a pressurized well without fluid or pressure leakage between the coating and the flexible wire. Accordingly, for at least the foregoing reasons, a need exists in the petroleum industry for an efficient and inexpensive apparatus and method for directionally disposing a flexible member, e.g., antenna, into a pre-determined location within a well bore without the costly and time-consuming requirement of removing production components, which impede the disposal of the flexible member in the well bore from an opening coaxial with a longitudinal axis of a wellhead, and also without the potential for leakage of fluid or pressure out of the pressurized well.

The present invention provides a unique solution to at least the foregoing need by providing an apparatus and method for directionally disposing a flexible member in a pressurized conduit without substantial leakage of pressure or fluid from the well resulting from the insertion of the flexible member into the well. In at least one aspect, the present invention relates to an apparatus sized and configured to allow for at least one flexible antenna to be inserted into an opening in a pressurized hydrocarbon well in a substantially perpendicular direction from the longitudinal axis of the wellhead. Typically, such an opening is in fluid communication with a casing valve coupled to the wellhead. Such an opening is unhindered by production components, save for production tubing, and provides access to the annular space between the casing and the production tubing. In at least one aspect of the invention, the annular space is the preferred location of the flexible antenna.

Thus, the present invention in one aspect is an apparatus for directionally disposing an elongated flexible member into a pressurized conduit defining at least one opening in fluid communication with a well valve. The apparatus includes an elongated hollow body comprising a bent end portion and an elongated portion. The bent end portion is sized and configured to be inserted into a pre-determined location within the pressurized conduit through the opening and the well valve and to receive a lead portion of the elongated flexible member therethrough. The apparatus also includes a primary valve comprising a first end portion and a second end portion and defining a fluid passageway connecting the first end portion and second end portion. The first end portion of the primary valve is sized and configured to be in a sealed fluid relationship with a first portion of the elongated portion of the elongated hollow body and the second end portion of the primary valve is sized and configured to receive the lead portion of the elongated flexible member therethrough. The fluid passageway of the primary valve is in a substantially sealed fluid relationship with the pressurized conduit and further is operable to control the passage of fluid through the fluid passageway. The apparatus further includes an end cap coupled to and in a substantially sealed relationship with a distal end portion of the elongated flexible member and at least a first lock sized and configured to releasably retain the bent end portion of the elongated hollow body in the pre-determined location in the pressurized conduit and a second lock sized and configured to releasably retain the elongated flexible member after insertion of the lead portion of the elongated flexible member through the bent end portion.

Another aspect of this invention is a method comprising inserting a bent end portion of an elongated hollow body through an opening in fluid communication with a well valve and defined by a pressurized conduit. The bent end portion is disposed in a pre-determined direction and location within the pressurized conduit. The method also includes inserting a lead portion of an elongated flexible member into a fluid passageway defined by a primary valve, the fluid passageway of the primary valve being in sealed fluid relationship with the elongated hollow body which is, in turn, is in sealed fluid relationship with the pressurized conduit, so that the lead portion of the elongated flexible member is inserted through the bend end portion and into the pressurized conduit by a pre-determined distance and, thereafter, retaining in place the inserted elongated flexible member, whereby the elongated flexible member is directionally disposed in the pressurized conduit.

These and other features, advantages, and aspects of this invention will be still further apparent from the ensuing detailed description, accompanying drawings, and appended claims.

BRIEF DESCRIPTION OF THE DRAWINGS

In each of the above figures, like numerals are used to refer to like or functionally like parts among the several figures.

FURTHER DETAILED DESCRIPTION OF THE INVENTION

Illustrative implementations of the invention are described below as they might be employed in the construction and use of an apparatus and method for directionally disposing an elongated flexible member in a pressurized conduit according to at least one implementation of the present invention. In the interest of clarity and conciseness, not all trivial features of an actual implementation are described in this specification. It will be of course appreciated that in the development of such an actual implementation of the same, numerous implementation-specific decisions must be made to achieve the developers' specific goals, such as compliance with system-related and business-related constraints, budgets, and so forth, which will vary from one implementation to another. Moreover, it will be appreciated that such a development effort might be complex and time-consuming, but would nevertheless be a routine undertaking for those of ordinary skill in the art having the benefit of this disclosure.

In one of its aspects, the present invention provides an apparatus and method for the directionally disposing one or more antennas into a pressurized well. In such an application, the antenna(s) may be used to propagate radio and/or microwave wave forms into the well bore and surrounding formation. In certain hydrocarbon wells, the deployment of an antenna(s) may be carried out in confined areas, under pressure, without the venting of pressure and potentially hazardous gases and liquids from the well. It may be desired to deploy the antenna(s) into the well annular space between the casing and production tubing, commonly known as the annulus. The geometry of the annulus and the associated configuration of the wellhead in certain hydrocarbon wells may require the antenna(s) to make a ninety degree bend over a narrow radius in order to fully deploy in the annulus. This narrow bend radius may range from two inches to less than one inch in diameter. The present invention provides a unique solution to the problems encountered with inserting one or more flexible antennas into a pressurized hydrocarbon well through such a narrow bend radius under conditions such as those described above.

Figure 1:
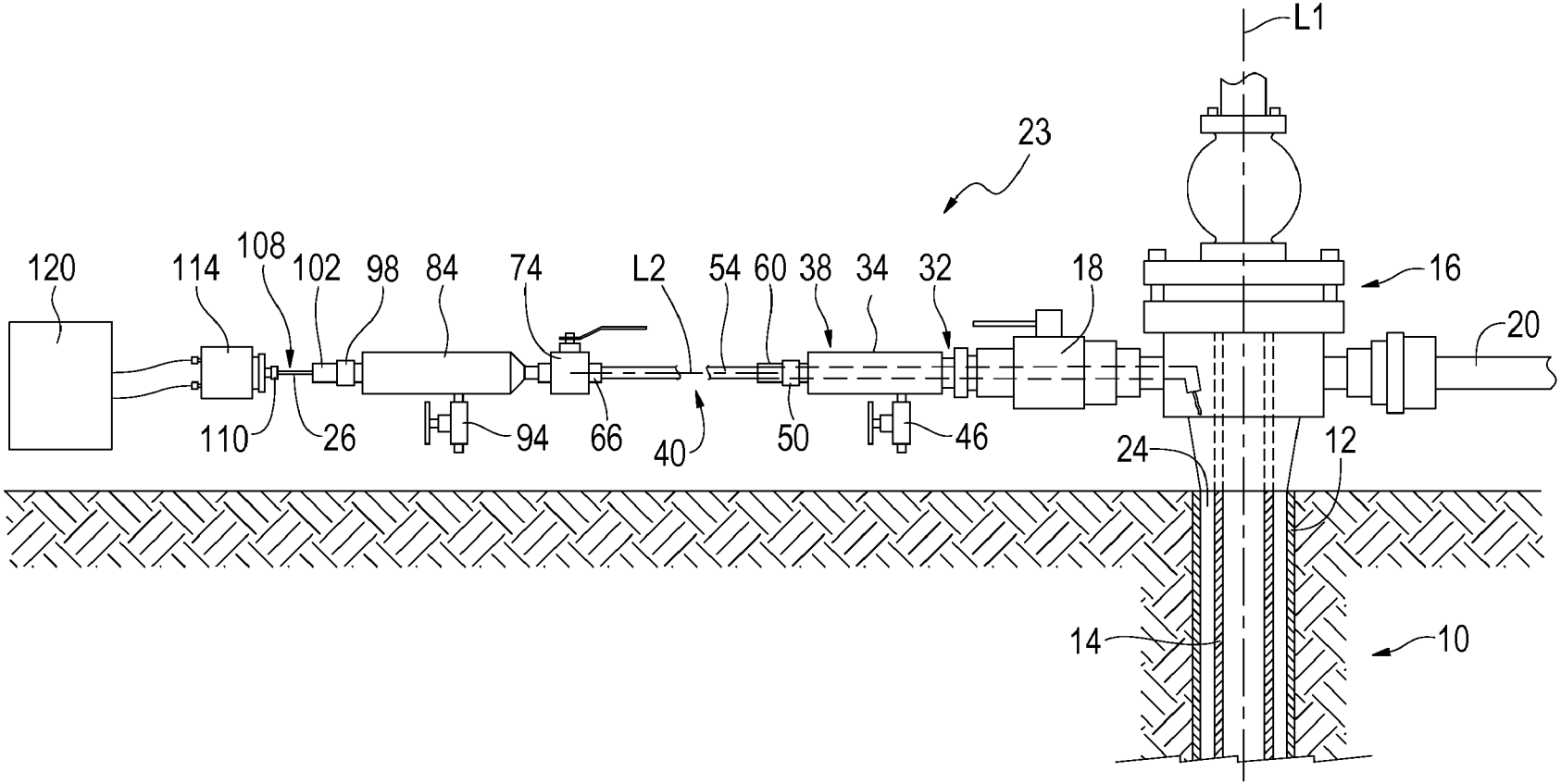
FIG. 1 is a side view of an apparatus in accordance with one aspect of the present invention coupled to a casing valve.
Figure 2:
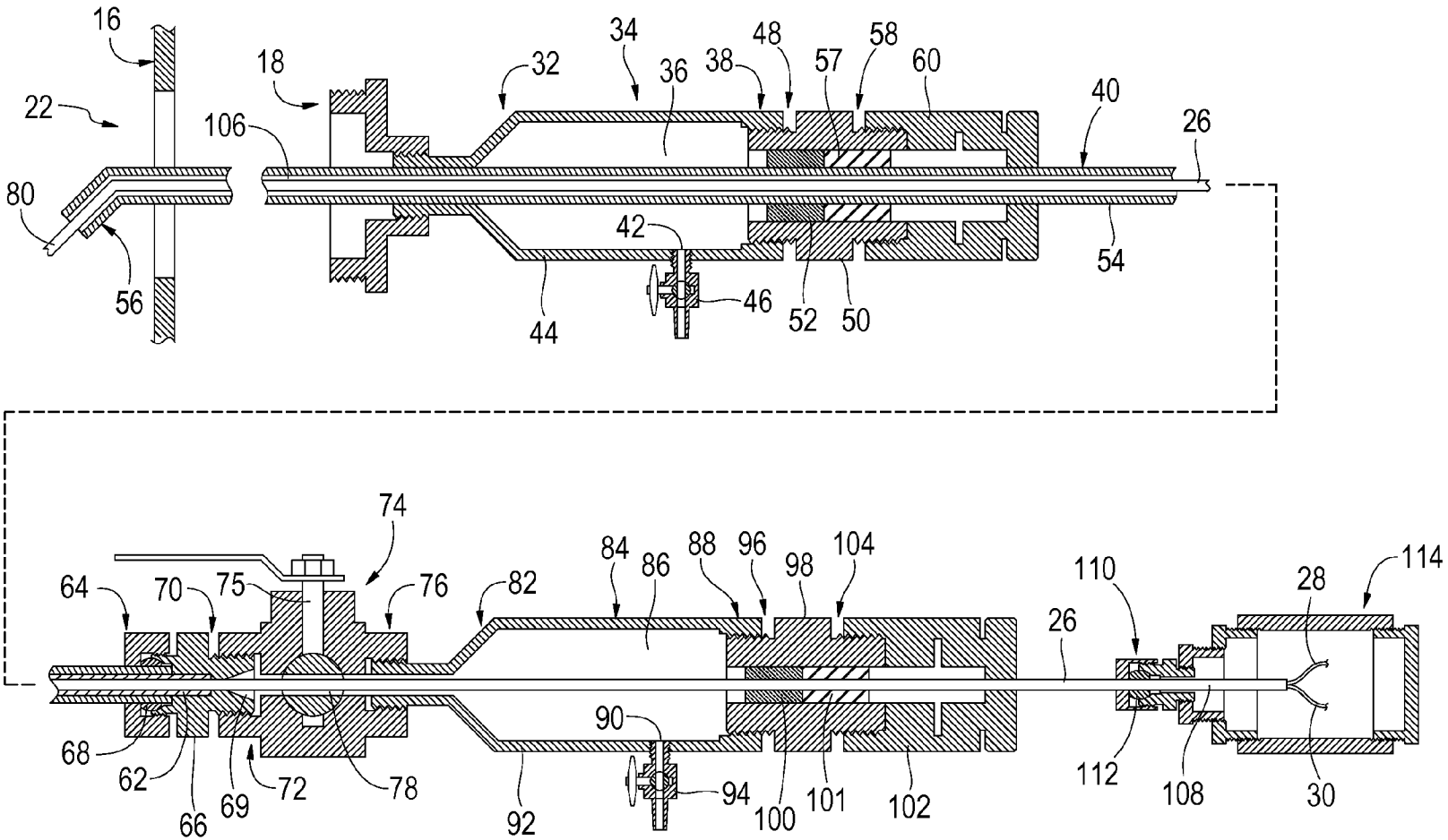
FIG. 2 is a cross-sectional view of the apparatus of FIG. 1 coupled to the casing valve.
Figure 4:
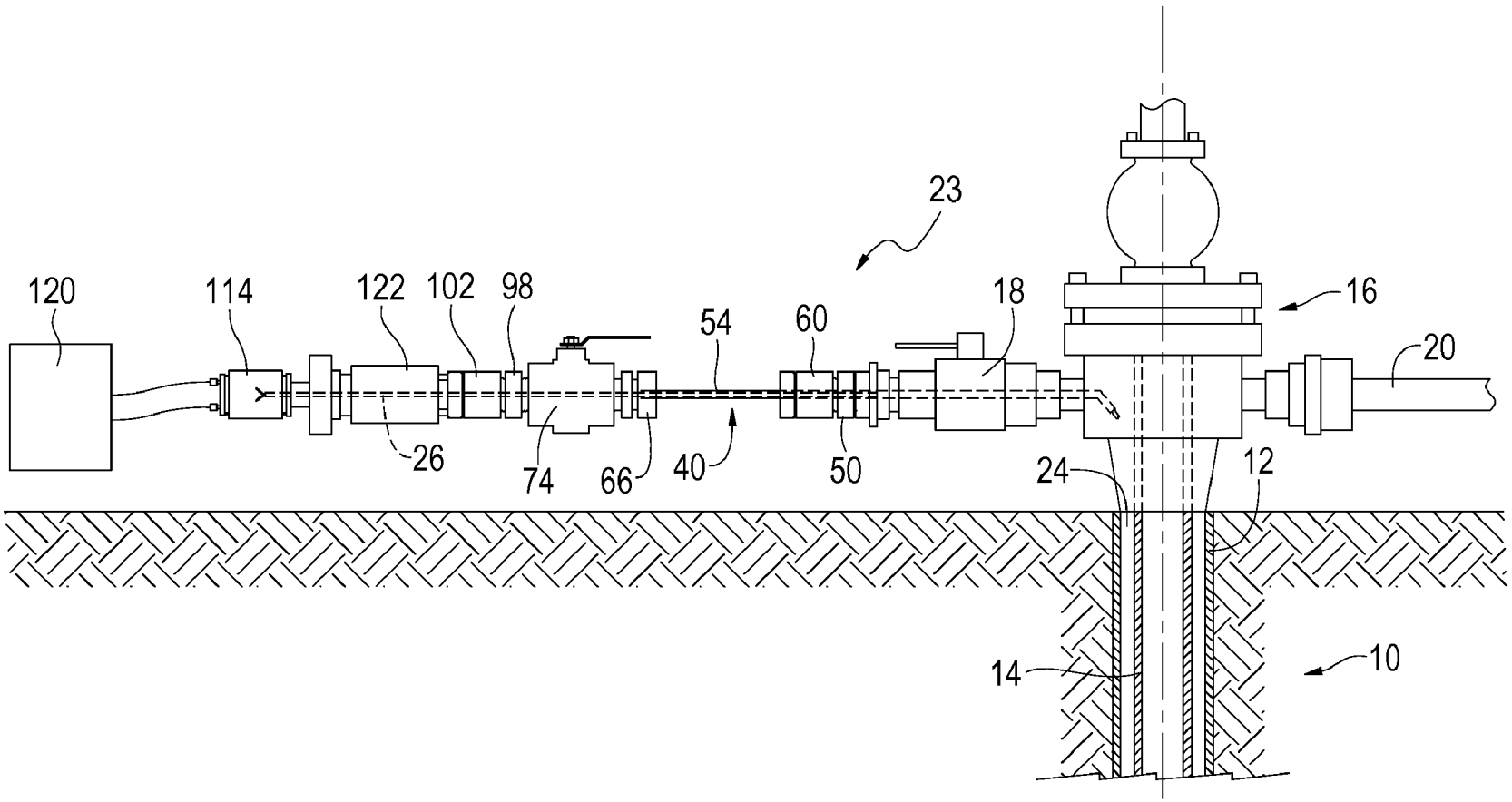
FIG. 4 is a side view of an apparatus in accordance with one aspect of the present invention coupled to a casing valve.

Turning now to the Figures, a completed hydrocarbon well 10 is shown in FIGS. 1 and 4 having at least surface casing 12 and production tubing 14. For illustrative purposes, a representative wellhead 16 is shown, including a casing valve 18 extending from the wellhead in a direction substantially perpendicular to a longitudinal axis L1 of the wellhead and a production flow line 20 extending substantially perpendicular to the longitudinal axis of the wellhead on the opposing side of the wellhead. It should be appreciated that the well configuration is illustrated generally and the present invention may be used with other wellhead configurations. As shown in FIGS. 1 and 2, wellhead 16 defines an opening 22 proximate to casing valve 18, wherein the opening is in fluid communication with the casing valve and the pressurized fluid in the annulus 24.

Shown attached to the casing valve in FIGS. 1 and 2 is an apparatus 23 for directionally disposing a elongated flexible member 26, including a first antenna 28 and a second antenna 30 disposed therein, in the hydrocarbon well 10 according to one aspect of the present invention. Apparatus 23, as attached to casing valve 18, is in fluid communication with hydrocarbon well 10. As illustrated in FIGS. 1 and 2, a first end portion 32 of a first enlarged housing 34 is threadingly attached in a substantially sealed relationship to casing valve 18. First enlarged housing 34 is a stainless steel, cylindrical primary housing. Although illustrated as cylindrical, the primary housing 34 may form multiple sidewalls and may be, e.g., hexagonal in shape. The outer diameter of the cylindrical primary housing is preferably two inches. The cylindrical primary housing is preferably constructed from stainless steel, but other nonlimiting materials may include mild steel, aluminum, or any other electrical conductive material suitable for the pressure and well fluids. Cylindrical primary housing 34 further defines an inner cavity 36 in fluid communication with first end portion 32 and a second end portion 38 and is sized and configured to receive a hollow tubing 40 therethrough, discussed below.

In FIGS. 1 and 2, cylindrical primary housing 34 further defines an opening 42 in a sidewall 44 wherein a bleed valve 46 is sealingly attached to the cylindrical primary housing at the opening and provides a mechanism for bleeding pressure accumulating in the cylindrical primary housing from pressurized hydrocarbon well 10. Bleed valve 46 may be any conventional bleed valve commercially available. One such example is a ¼ inch stainless steel needle valve, manufactured by Swagelok Company of Solon, Ohio.

Threadingly attached to second end portion 38 of cylindrical primary housing 34 is a first end portion 48 of a primary seal housing 50, illustrated in FIGS. 1 and 2 as a primary packing housing. Primary packing housing 50 includes a primary seal 52, shown as primary packing, constructed of TEFLON® material and disposed within the primary packing housing. The primary packing may be formed from other materials, including but not limited to any elastomer such as rubber or a rubber derivative, VITON®, polyethylene, or any other elastomer commonly used in the petroleum industry. Primary packing 52 is sized and configured to slidably receive in a substantially sealed relationship a portion of an elongated portion 54 of hollow tubing 40 therethrough, which will be further discussed below. To achieve this substantially sealed relationship, the primary packing is formed from a solid piece of TEFLON® material sized and configured to fill the primary packing housing and to seal around the hollow tubing. It should be appreciated that other packing configurations could be used, e.g., packing glands and O-rings capable of making a tight, leak-free seal.

Figure 5:
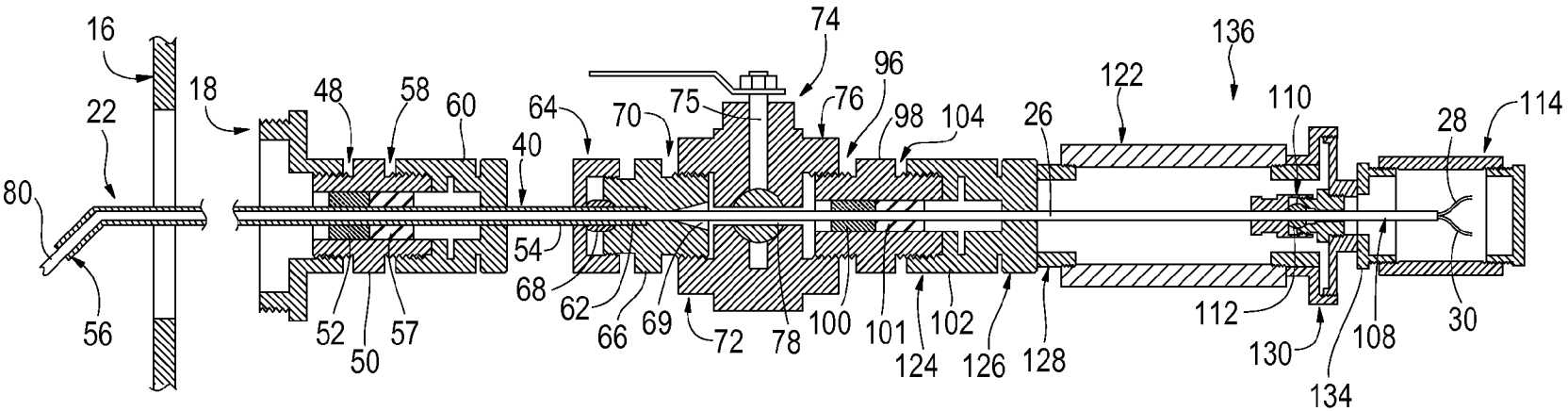
FIG. 5 is a cross-sectional view of the apparatus of FIG. 4 coupled to the casing valve.

Optionally, first end portion 48 of primary packing housing 50 may be directly coupled to casing valve 18 as shown in FIGS. 4 and 5. In such an instance, the first end portion of the primary packing housing may be sized and configured to threadingly attach to the casing valve in a substantially sealed relationship. Such a configuration may include additional bushings, nipples, and/or collars known to those in the art to mate the primary packing housing to the casing valve in order to form a substantially sealed relationship. In such instances, the cylindrical primary housing is not practiced in this particular aspect of the invention.

Shown in FIGS. 1 and 2 is elongated hollow body 40 including a bent end portion 56 and elongated portion 54. Elongated hollow body 40, as illustrated, is hollow tubing. The hollow tubing is preferably constructed from stainless steel; however, nonlimiting examples of other suitable materials may include aluminum, polyethylene, reinforced polyethylene, mild steel, or any other material suitable for withstanding the well pressures and fluids contained therein. As illustrated in FIGS. 1 and 2, bent end portion 56 of hollow tubing 40 is integral with elongated portion 54, i.e., the hollow tubing including the bent end portion is one continuous, unitary construction. Optionally, the bent end portion may be a separate component attached to the elongated portion of the hollow tubing. Bent end portion may be attached by any means known in the art capable of withstanding pressure and temperature conditions in the well. For example, the bent end portion may be a machined fitting threaded, coupled, or welded to the end of the hollow tubing, or be an insert designed to fit inside the hollow tubing that could direct the elongated flexible member, discussed below, in a preferred direction. The hollow tubing may range from about ¼ inch to one inch in outer diameter. Preferably, the outer diameter of the hollow tubing may be either ½ inch, ⅜ inch, or ¼ inch. The internal diameter of the hollow tubing may vary in size; however, the inner bore of the hollow tubing will be sized and configured such that elongated flexible member 26, illustrated as antenna tubing and discussed in detail below, may be disposed within hollow tubing 40 such that the antenna tubing may be slidably urged along the length of the hollow tubing. Bent end portion 56 of the hollow tubing will be orientated preferably about 10 degrees to about 60 degrees from a longitudinal axis of the elongated portion of the elongated hollow body. Although such angle is preferred, it should be understood that the bent end portion may be oriented at angles in a broader range of angles which are less than or greater than those in the preferred range. Such broader range may include, e.g., any angle between zero and one hundred and eighty degrees.

A second end portion 58 of the primary packing housing 50 is threadingly attached to a first lock 60, illustrated as a primary locking nut in FIGS. 1 and 2. The primary locking nut is sized and configured to slidably receive the elongated portion of the hollow tubing therethrough. The primary locking nut may be any conventional locking nut capable of functioning to releasably retain the bent end portion of the hollow tubing in the pre-determined location in the hydrocarbon well, which will be discussed below. To assemble a portion of the apparatus, in at least one aspect, cylindrical primary housing 34, primary packing housing 50 and primary locking nut 60 are slidably urged from an end portion 62 of elongated portion 54 of hollow tubing 40 along the length of the hollow tubing in the direction of bent end portion 56. The cylindrical primary housing, primary packing housing and primary locking nut may be coupled together prior to or after the aforementioned components are urged along the length of the hollow tubing; however, in at least one aspect, cylindrical primary housing, primary packing housing and primary locking nut should be assembled and coupled to casing valve prior to bent end portion being inserted through the opening into the wellhead.

A first end portion 64 of a secondary seal housing 66, illustrated as a primary compression fitting in FIGS. 1 and 2, is attached to end portion 62 of elongated portion 54 of hollow tubing 40. Primary compression fitting 66 includes a secondary seal 68, shown in FIGS. 1 and 2 as a primary compression ring, disposed within the primary compression fitting. The primary compression ring is sized and configured to receive in a substantially sealed relationship the end portion of the elongated portion of the elongated hollow body therethrough. A second end portion 70 of primary compression fitting 66 defines a tapered or, generally, a cone-shaped inner cavity 69. Such a cone-shaped inner cavity aids in the insertion of the antenna tubing into the end portion of the elongated portion of the hollow tubing by guiding the antenna tubing into the end portion of the elongated portion of the hollow tubing.

Second end portion 70 of primary compression fitting 66 is threadingly attached to a first end portion 72 of a primary valve 74, illustrated as a ball valve, in a substantially sealed relationship. As shown in FIGS. 1 and 2, ball valve 74 includes first end portion 72 and a second end portion 76 and defines a fluid passageway 78 connecting the first end portion and second end portion. First end portion 72 of ball valve 74 is sized and configured to be in a sealed fluid relationship with end portion 62 of elongated portion 54 of hollow tubing 40 and the second end portion of the ball valve is sized and configured to receive a lead portion 80 of antenna tubing 26 therethrough, discussed further below. The fluid passageway of the ball valve is in a substantially sealed fluid relationship with the hydrocarbon well and the ball valve is operable to control the passage of fluid and pressure through the fluid passageway. Ball valve prevents fluids, gases, and pressure from blowing through the hollow tubing into the external environment during the deployment of the bent end portion in the well when ball valve is in the "closed" position. Ball valve may be any conventional ball valve available. One such nonlimiting example includes an Apollo valve ½ female/female 2000 psi, manufactured by Conbraco of Mathews, N.C.

In one aspect of the operation of the present invention, casing valve 18 is determined to be in a "closed" position, i.e., the pressure and/or fluid from hydrocarbon well 10 may not exit through the casing valve to the external environment. Cylindrical primary housing 34, primary packing housing 50, and locking nut 60 are slidably received by end portion 62 of elongated portion 54 of hollow tubing 40 and further slidably urged at least partially along the length of the hollow tubing toward bent end portion 56 of the hollow body. Second end portion 38 of the cylindrical primary housing is threadingly attached to first end portion 48 of the primary packing housing and second end portion 58 of the packing housing is threadingly attached to primary locking nut 60. As illustrated, first end portion 32 of the cylindrical primary housing is threadingly attached to the casing valve in a sealing relationship. Second end portion 70 of primary compression fitting 66 is coupled to first end portion 72 of ball valve 74 and first end portion 64 of the primary compression fitting 66 sealingly receives the end portion 62 of elongated portion 54 of hollow body 40. The ball valve is manipulated so that a valve stem 75 or other valve sealing means of the ball valve obstructs fluid passageway 78 defined by the ball valve thereby effectively sealingly closing the ball valve.

Casing valve 18 is then manipulated into the "open" position, such that annulus 24 is in fluid communication with inner cavity 36 of cylindrical primary housing 34. Bent end portion 56 being sized and configured to be inserted into annulus 24 within pressurized hydrocarbon well 10 is slidably inserted into opening 22 in fluid communication with casing valve 18 by urging end portion 62 of hollow body 40 or any other portion of hollow body accessible to a person manipulating the hollow body such that elongated portion 54 of the hollow body is slidably urged through the locking nut, packing housing, and cylindrical primary housing toward opening 22 such that the bent end portion is inserted into annulus 24 of hydrocarbon well 10. The person, e.g., operator, urging the elongated portion of the hollow body typically will urge the hollow body into the well until he/she feels the bent end portion contact the production tubing. At this moment, the operator will remove approximately a few inches of the hollow body to ensure that the bent end portion remains in the annulus, but out of contact with the production tubing. Primary locking nut 60 is then manipulated to push on a metal sleeve 57 disposed within primary packing housing 50, which correspondingly squeezes primary packing 52, which tightens and seals around hollow body 40 effectively locking the bent end portion in a determined location within the annulus. In order for the operator to know the orientation of the bent end portion in the annulus, i.e., whether the bent end portion is facing down hole, a mark or other indicator is made on a portion of the hollow body visible to the operator and indicative of the orientation of the bent end portion.

As illustrated in FIG. 2, threadingly attached in a substantially sealed relationship to second end portion 76 of ball valve 74 is a first end portion 82 of a second enlarged housing 84. In the embodiment illustrated, second enlarged housing 84 is a stainless steel, cylindrical secondary housing. Although illustrated as cylindrical, the secondary housing may form multiple sidewalls and may be, e.g., hexagonal in shape. The outer diameter of the cylindrical secondary housing is preferably two inches. The cylindrical secondary housing is preferably constructed from stainless steel, but other nonlimiting materials may include mild steel, aluminum, or any other electrical conductive material suitable for the pressure and well fluids. The cylindrical secondary housing 84 further defines an inner cavity 86 in fluid communication with first end portion 82 and a second end portion 88 and is sized and configured to receive antenna tubing 26 therethrough, discussed below.

In FIGS. 1 and 2, cylindrical secondary housing 84 further defines an opening 90 in a sidewall 92 wherein a bleed valve 94 is sealingly attached to the cylindrical secondary housing at the opening and provides a mechanism for bleeding pressure accumulating in the cylindrical secondary housing from pressurized hydrocarbon well 10. Bleed valve may be any conventional bleed valve commercially available. One such example is a ¼ inch stainless steel male/female needle valve, manufactured by Swagelok of Solon, Ohio.

Shown threadingly attached to second end portion 88 of cylindrical secondary housing 84 is a first end portion 96 of a tertiary seal housing 98, illustrated as a secondary packing housing. Secondary packing housing 98 includes a seal 100, illustrated as a secondary packing, disposed within the secondary packing housing and sized and configured to slidably receive in a substantially sealed relationship lead portion 80 of antenna tubing 26 therethrough, discussed below. To achieve this substantially sealed relationship, the secondary packing is formed from a solid piece of TEFLON® material sized and configured to fill the secondary packing housing and to seal around the hollow tubing. It should be appreciated that other packing configurations could be used, e.g., packing glands and O-rings capable of making a tight, leak-free seal.

As illustrated, first end portion 96 of secondary packing housing 98 is coupled to cylindrical secondary housing 84 in a substantially sealed relationship. Optionally, first end portion 96 of secondary packing housing 98 may be coupled to ball valve 74 in a substantially sealed relationship as shown in FIGS. 4 and 5. First end portion 96 may be sized and configured to threadingly attach to the ball valve in a substantially sealed relationship. Such a configuration may include additional bushings, nipples, and/or collars known to those in the art to mate the first end portion of the secondary packing housing to the ball valve in order to form a substantially sealed relationship. In such instances, the cylindrical secondary housing is not practiced in the present invention.

A first end portion 124 of a second lock 102, illustrated in FIGS. 1 and 2 as a secondary locking nut, is threadingly attached to a second end portion 104 of secondary packing housing 98. Secondary locking nut 102 is sized and configured to slidably receive lead portion 80 of antenna tubing 26 therethrough. The secondary locking nut may be any conventional locking nut capable of functioning to releasably retain the antenna tubing after insertion of the lead portion of the antenna tubing through the bent end portion of the hollow tubing, which manner will be discussed below.

As shown in FIGS. 1 and 2, elongated flexible member 26, illustrated as an antenna tubing, defines an elongated bore 106 therethrough, and first antenna 28 and second antenna 30 are disposed within the elongated bore. The antennas may include solid core or a braided conductive wire sized and configured to be disposed within the antenna tubing. The antenna tubing is preferably ¼ inch to ⅜ inch in outer diameter. Antenna tubing may be constructed from polyethylene, preferably reinforced polyethylene tubing comprising SAE J844 air brake hose. The antennas may be coaxial cable having coated metal sheaths. The coating may be plastic, polyethylene, or TEFLON® coating. The coating aids in keeping the antennas from directly contacting or shorting on the production tubing or casing. The length of each antenna may range from a few inches to over a hundred feet. In most instances, the antenna length matches the frequency wavelength of the wave from to be transmitted from the antenna, e.g., a radio frequency wavelength or a VHF or super high frequency microwave wavelength. An antenna transmitting radio wave forms may transmit at one or more frequencies in the range of about 1 to about 100 megahertz. An antenna transmitting microwave forms may transmit at one or more frequencies in the range of about 1 to about 100 gigahertz. In one aspect, the antennas may be inserted into the annulus of the well to a depth of two to thirty feet.

Figure 3:
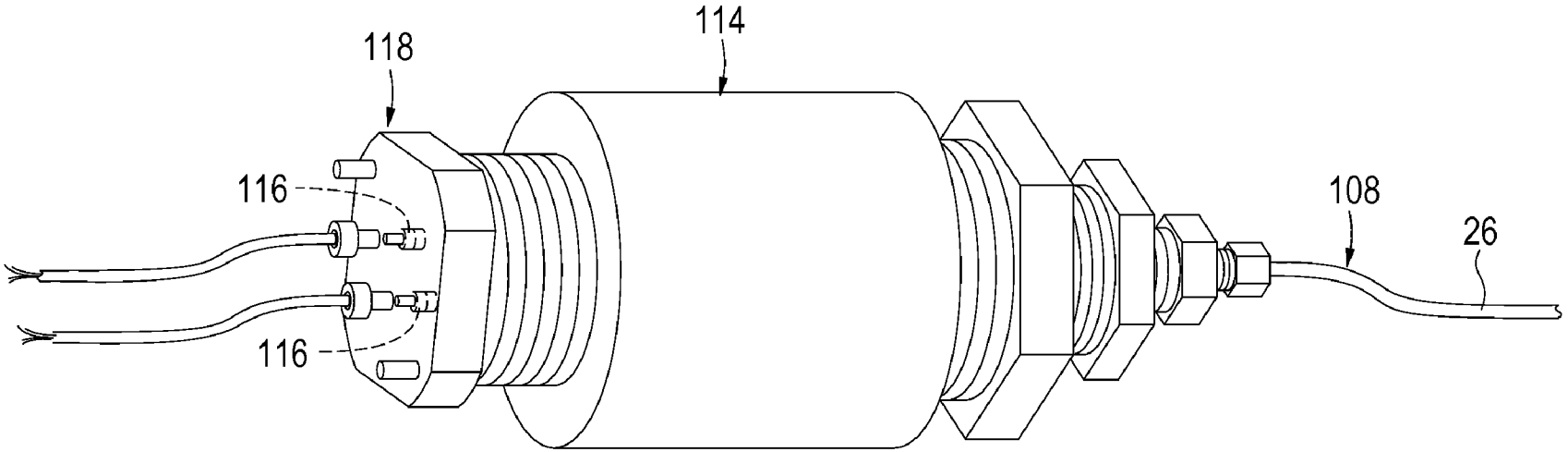
FIG. 3 is an end cap consistent with another aspect of the present invention, wherein the end cap comprises electrical fittings sized and configured to be coupled to the antennas.

A distal end portion 108 of antenna tubing 26 is fed through a secondary compression fitting 110 including a secondary compression ring 112, and into a leak proof and pressure proof end cap 114 to prevent leaking of fluids, gases, and pressure between the solid or braided antenna wire and the coating, as further illustrated in FIG. 3. The secondary compression ring is disposed within the secondary compression fitting and is sized and configured to receive in a substantially sealed relationship the distal portion of the antenna tubing therethrough. The secondary compression fitting is preferably ¼ inch or ⅜ inch in outer diameter.

As shown in FIG. 3, end portion 118 of end cap 114 includes electrical connections or fittings 116 suitable for the voltage, temperature and pressure of the pressurized well. The electrical connections are pressure rated for the preferred embodiment and prevent leakage of pressure, gasses, or fluids from the end cap. Each antenna is coupled to a respective electrical fitting.

Electrical fittings 116 may be further coupled to an external source 120 capable of generating wave forms of the frequencies disclosed above, i.e. about one to about 100 megahertz and about 1 to about 100 gigahertz. The external source may be any conventional wave form generator, or a generator customized for a given application. It should be appreciated that various wave form generators may be practiced with the present invention so long as the wave forms may be generated at the frequencies disclosed above.

Optionally, as shown in FIGS. 4 and 5, secondary locking nut 102 may have attachment means, such as a collar 122, welded or attached at one end portion to a first set of fittings 128 welded or attached to a second end portion 126 of the secondary locking nut. The opposing end portion of the collar may accept a second set of fittings 130. The second set of fittings may be welded or attached to a first end portion 134 of end cap 114. The first set of fittings and second set of fittings are sized and configured to mate with collar 122 such that the attached fittings and collar form a union assembly 136, as shown in FIGS. 4 and 5. Antenna tubing 26 and compression fitting 110 are disposed within union assembly 136.

In one aspect of operation of the invention, bent end portion 56 is inserted into annulus 24 of hydrocarbon well 10. Primary locking nut 60 is then manipulated and tightened around hollow body 40 effectively locking the bent end portion in a determined location within the annulus. First antenna 28 and second antenna 30 are disposed within antenna tubing 26. A distal end portion 108 of antenna tubing 26 is fed through a secondary compression fitting 110 including a secondary compression ring 112, and into a leak proof and pressure proof end cap 114. First antenna 28 and second antenna 30 are connected to respective electrical fittings 116. Secondary compression fitting 110 is attached to end cap 114.

First end portion 82 of cylindrical secondary housing 84 is threadingly attached in a substantially sealed relationship to second end portion 76 of ball valve 74. Threadingly attached to second end portion 88 of cylindrical secondary housing 84 is first end portion 96 secondary packing housing 98. First end portion 124 of secondary locking nut 102 is threadingly attached to second end portion 104 of secondary packing housing 98. Lead portion 80 of antenna tubing 26 is inserted into and through secondary locking nut 102 and secondary packing housing 98. Ball valve 74 is manipulated into an "open" position and lead portion 80 of antenna tubing 26 is slidably urged through the fluid passageway 78 into primary compression fitting 66 wherein the cone-shaped inner cavity 69 of second end portion 70 guides the lead portion 80 into elongated portion 54 of hollow tubing 40. Lead portion 80 is slidably urged through primary locking nut 60, primary packing housing 50, and cylindrical primary housing 34 toward bent end portion 56.

Lead portion 80 is slidably urged into and through bent end portion 56, which is fixably positioned in annulus 24. Lead portion 80 is slidably urged into annulus 24 beyond bent end portion 56 until the lead portion is at the desirable depth pre-determined by the operator. Secondary locking nut 102 is manipulated to push on a secondary metal sleeve 101 disposed within secondary packing housing 98, which correspondingly squeezes secondary packing 100, which tightens and seals around antenna tubing 26 effectively locking lead portion 80 of antenna tubing at the desired depth in annulus 24. In another aspect illustrated in FIG. 5, collar 122 is mated to first set of fittings 128 and second set of fittings 130, forming union assembly 136.

Electrical fittings 116 are coupled to external source 120. The external source is activated to produce wave forms at the desired frequency for first antenna 28 and second antenna 30, thereby providing a first antenna to transmit radio wave forms at one or more frequencies in the range of about 1 to about 100 megahertz and a second antenna to transmit wave forms at one or more frequencies in the range of about 1 to about 100 gigahertz.

Optionally, a chemical treatment tubing may be disposed within the elongated flexible member. The chemical treatment tubing may be used for the delivery of chemicals to treat the formation and/or production fluids. In such an aspect, the external source may be a pump or the like capable of providing the chemicals down hole and end cap may be sized and configured to be coupled to the pump.

Except as may be expressly otherwise indicated, the article "a" or "an" if and as used herein is not intended to limit, and should not be construed as limiting, the description or a claim to a single element to which the article refers. Rather, the article "a" or "an" if and as used herein is intended to cover one or more such elements, unless the text expressly indicates otherwise.

This invention is susceptible to considerable variation within the spirit and scope of the appended claims.

The invention claimed is:

1. An apparatus for directionally disposing an elongated flexible member into a pressurized conduit defining at least one opening in fluid communication with a well valve, the apparatus comprising:

an elongated hollow body comprising a bent end portion and an elongated portion, wherein the bent end portion is sized and configured to be inserted into a pre-determined location within the pressurized conduit through the opening and the well valve and to receive a lead portion of the elongated flexible member therethrough;

a primary valve comprising a first end portion and a second end portion and defining a fluid passageway connecting the first end portion and second end portion, the first end portion of the primary valve being sized and configured to be in a sealed fluid relationship with a first portion of the elongated portion of the elongated hollow body and the second end portion of the primary valve being sized and configured to receive the lead portion of the elongated flexible member therethrough, the fluid passageway of the primary valve being in a substantially sealed fluid relationship with the pressurized conduit and further being operable to control the passage of fluid through the fluid passageway;

an end cap coupled to and in a substantially sealed relationship with a distal end portion of the elongated flexible member; and at least a first lock sized and configured to releasably retain the bent end portion of the elongated hollow body in the pre-determined location in the pressurized conduit and a second lock sized and configured to releasably retain the elongated flexible member after insertion of the lead portion of the elongated flexible member through the bent end portion;

wherein the bent end portion is oriented at about 10 degrees to about 60 degrees from a longitudinal axis of the elongated portion of the elongated hollow body;

wherein the pressurized conduit is a hydrocarbon well casing and the pre-determined location is an annulus between the hydrocarbon well casing and a production tube;

further comprising a primary seal housing comprising a primary seal, a first primary seal housing end portion, and a second primary seal housing end portion, wherein the primary seal is disposed within the primary seal housing and is sized and configured to slidably receive in a substantially sealed relationship a second portion of the elongated portion of the elongated hollow body therethrough, and the first primary seal housing end portion is coupled to the well valve in a substantially sealed relationship;

wherein the first lock is coupled to the second primary seal housing end portion; and further comprising a secondary seal housing comprising a secondary seal, a first secondary seal housing end portion, and a second secondary seal housing end portion defining a cone-shaped inner cavity, wherein the secondary seal is disposed within the secondary seal housing and is sized and configured to receive in a substantially sealed relationship the first portion of the elongated portion of the elongated hollow body therethrough, and the second secondary seal housing end portion is coupled to the primary valve in a substantially sealed relationship.

2. The apparatus of claim 1 further comprising a tertiary seal housing comprising a tertiary seal, a first tertiary seal housing end portion, and a second tertiary seal housing end portion, wherein the tertiary seal is disposed within the tertiary seal housing and is sized and configured to slidably receive in a substantially sealed relationship the lead portion of the elongated flexible member therethrough, and the first tertiary seal housing end portion is coupled to the primary valve in a substantially sealed relationship.

3. The apparatus of claim 2 wherein the second lock is coupled to the second tertiary seal housing end portion.

4. The apparatus of claim 1, wherein the elongated flexible member defines an elongated bore therethrough, and one or more antennas are disposed within the elongated bore; and further comprising a first antenna sized and configured to transmit radio waves at one or more frequencies in the range of about 1 to about 100 megahertz and a second antenna sized and configured to transmit microwaves at one or more frequencies in the range of about 1 to about 100 gigahertz.

5. A method comprising: inserting a bent end portion of an elongated hollow body through an opening in fluid communication with a well valve and defined by a pressurized conduit, the bent end portion being disposed in a pre-determined direction and location within the pressurized conduit; inserting a lead portion of an elongated flexible member into a fluid passageway defined by a primary valve, the fluid passageway of the primary valve being in sealed fluid relationship with the elongated hollow body which, in turn, is in sealed fluid relationship with the pressurized conduit, so that the lead portion of the elongated flexible member is inserted through the bent end portion and into the pressurized conduit by a pre-determined distance; thereafter retaining in place the inserted elongated flexible member, whereby the elongated flexible member is directionally disposed in the pressurized conduit; further comprising disposing one or more antennas within an elongated bore defined by the elongated flexible member; wherein a distal end portion of the elongated flexible member is in a substantially sealed relationship with an end cap comprising at least one electrical fitting sized and configured to transmit one or more electromagnetic wave forms from an external source to the one or more antennas and to be coupled to the one or more antennas; and further comprising coupling a first antenna to a first electrical fitting and coupling a second antenna to a second electrical fitting, wherein the first antenna is sized and configured to transmit radio waves at a frequency in the range of about 1 to about 100 megahertz and the second antenna is sized and configured to transmit microwaves at a frequency in the range of about 1 to about 100 gigahertz.

6. The method of claim 5 wherein the bent end portion is oriented at an angle in the range of about 10 to about 60 degrees from a longitudinal axis of an elongated portion of the elongated hollow body, wherein the pressurized conduit is a hydrocarbon well casing and the pre-determined location is a portion of an annulus between the hydrocarbon well casing and a production tube; and further comprising disposing a first primary seal housing end portion of a primary seal housing in fluid sealing communication with the well valve and a second primary seal housing end portion of the primary seal housing being sized and configured to slidably receive in a sealing relationship a second portion of the elongated hollow body.

7. The method of claim 6 further comprising adjusting the second portion of the elongated hollow body so that the bent end portion of the elongated hollow body is in the pre-determined direction and location within the pressurized conduit.

8. The method of claim 6 further comprising retaining in place the second portion of the elongated hollow body.

9. The method of claim 6 further comprising disposing a second secondary seal housing end portion of a secondary seal housing in sealing communication with the primary valve and a first secondary seal housing end portion of the secondary seal housing being sized and configured to receive in a sealing relationship a first portion of the elongated hollow body.

10. The method of claim 9 further comprising disposing a first tertiary seal housing end portion of a tertiary seal housing in sealing communication with the primary valve and a second tertiary seal housing end portion of the tertiary seal housing being sized and configured to slidably receive in a sealing relationship the lead portion of the elongated flexible member.

11. The method according to claim 5 further comprising transmitting one or more electromagnetic wave forms from an external source through the electrical fitting to the one or more antenna;

further comprising transmitting radio waves from a first antenna at a frequency in the range of about 1 to about 100 megahertz; and further comprising transmitting microwaves from a second antenna at a frequency in the range of about 1 to about 100 gigahertz.

* * * * *